US007107811B2

(12) United States Patent
Zauhar

(10) Patent No.: US 7,107,811 B2
(45) Date of Patent: Sep. 19, 2006

(54) TOOL PACK ASSEMBLY

(76) Inventor: Mark L. Zauhar, 18756 Knollwood Cir., Lakeville, MN (US) 55044

( * ) Notice: Subject to any disclaimer, the term of this patent is extended or adjusted under 35 U.S.C. 154(b) by 0 days.

(21) Appl. No.: 11/251,395

(22) Filed: Oct. 14, 2005

(65) Prior Publication Data

US 2006/0086170 A1 Apr. 27, 2006

Related U.S. Application Data

(60) Provisional application No. 60/619,477, filed on Oct. 15, 2004.

(51) Int. Cl.
*B21D 22/00* (2006.01)

(52) U.S. Cl. ..... 72/349; 72/467; 72/466.8

(58) Field of Classification Search ..... 72/347, 72/466, 466.8, 467, 349
See application file for complete search history.

(56) References Cited

U.S. PATENT DOCUMENTS 658,187 A * 9/1900 Mohr ..... 72/347
4,183,237 A * 1/1980 Schaffer ..... 72/349
4,554,815 A * 11/1985 Weishalla ..... 72/349
4,843,863 A 7/1989 Grims et al.
4,852,377 A 8/1989 Mikas et al.
5,555,761 A 9/1996 Lavy
5,692,409 A 12/1997 Cheers et al.
5,740,692 A 4/1998 Dunwoody

* cited by examiner

*Primary Examiner*—Derris H. Banks
*Assistant Examiner*—Debra Wolfe
(74) *Attorney, Agent, or Firm*—Anthony G. Eggink; Katrina M. Eggink

(57) ABSTRACT

A tool pack assembly for use in the manufacture of two piece metal can bodies. The tool pack assembly of the present invention is constructed and arranged for use in a body maker assembly to form parts of metal cans. The tool pack assembly of the invention includes an improved die module structure. The improved die module includes compressible dampening structures to thereby float a die element to center and align the metal body with the die element.

20 Claims, 5 Drawing Sheets

TOOL PACK ASSEMBLY

This Application claims the benefit of U.S. Provisional Patent Application Ser. No. 60/619,477, filed on or about Oct. 15, 2004.

BACKGROUND OF THE INVENTION

The present invention relates generally to ironing mechanisms for use in the manufacture of metal containers. Particularly, the invention relates to a tool pack assembly used in the drawing and ironing of bodies for two piece steel and aluminum cans. More particularly, the invention relates to improved floating die module assemblies for use in a tool pack assembly for the manufacture of metal containers.

The tool pack assembly of the present invention is an improvement of the tool pack assembly disclosed in U.S. Pat. No. 4,554,815 ('815 Patent) to Weishalla, entitled Tool Pack Assembly and assigned to the assignee of Applicant's present Application. The tool pack assembly of the '815 Patent, incorporated by reference herein, utilizes floating ironing and guiding dies which axially realign within the internal housing area subsequent withdrawal of the ram from the formed container. Specifically, the centering and guiding means of the die modules of the tool pack assembly have been improved by the teachings of the present invention.

Tool pack assemblies typically house fixed and/or movable die elements which engage with rapid cycling softer materials positioned about a ram device for decreasing thickness of the material. Spatial control of the die elements along and normal to the axis of movement of the ram, is imperative for manufacturing production, quality and efficiency. The tool pack assemblies and die modules of the present invention improve these manufacturing parameters by providing improved dampening means to center and bias the die modules of the tool pack.

The improved dampening means of the invention for biasing a die assembly comprises an elastomeric spring member and a cooperating rigid contact member. The elastomeric urethane dampening member provides advantages over the coil springs used in the prior art, i.e., increased life, wider range of spring forces, and increased reliability of performance. The contact members further provide a plurality of wear surfaces which further increase the performance and life of the dampening structure. The cooperating dampening means components are positioned and held in die module housing cavities in which the components are easily accessible for maintenance and replacement in contrast to the coil springs used in prior art tool pack assemblies.

The die module housing of the present invention also has an improved structure by utilizing wear plates which are easily removable, thereby providing a more effectively serviceable and maintainable die module assembly. In the past, upon wear the entire module housing required grinding, for example, whereas in the module housing of the present invention only the wear plates need to be serviced. The tool pack assembly of the present invention provides improvements and advantages over those of the prior art.

SUMMARY OF THE INVENTION

The present invention relates to improved die modules and tool pack assemblies utilizing the die modules. The tool pack assembly of the invention is constructed and arranged for use in the manufacture of bodies for two piece metal can bodies. In manufacture, a first draw is performed, i.e. in a cupper or cupping assembly, to form a metallic ply or sheet metal component into cup-shape and to draw up the sides of a metal can body. A second draw and an ironing process, i.e. via a body maker, is then performed to thin the sides and increase the height of the can body. A bottom former or doming assembly may be incorporated for use with the body maker. A metal body or can is drawn through a body maker using a ram or punch device. The tool pack assembly of the present invention is constructed and arranged for use in a body-maker assembly for the manufacture of two piece cans. Specifically, the tool pack assembly of the present invention is constructed and arranged to form an annular internal housing area which is axially aligned with the ram or punch. Importantly, the component moved by the ram moves smoothly through the internal housing area.

A tool pack assembly may be comprised of various combinations of components including redraw die assemblies, single or double die assemblies, spacer devices and/or coolant spacer devices, for example, depending on size restraints or requirements and the desired process or effect on the can body. For example, the tool pack assembly of the invention may be comprised of a redraw die retainer, a redraw die carrier, a first single die module, a spacer member, a second single die module, a second spacer member, a coolant spacer member, and a third single die module. The tool pack elements form a housing area to hold die assemblies used for thinning the sides of a metal can. A die assembly may be comprised of a die ring and a die element, for example. Coolant/lubricant apertures are in communication with the housing to provide coolant to the metal body being formed. When metal can bodies are rammed or punched through the tool pack and body maker, heat is produced. If a can body becomes improperly centered and/or is too hot in a body maker, manufacturing and quality problems occur, i.e. tear-off and remelt. These problems may result in the shut down of the body maker to retrieve the damaged object(s), which results in a loss of production and efficiency. Thus, it is an advantage of the present invention to provide a tool pack assembly which minimizes production and quality problems.

The present invention provides a die module having improved dampening means. The die module may be a single or a double die module. The die module is a generally circular annular structure, and which forms a housing for a die ring and die element through which can bodies pass. The upstream side of the die module may contain a lube ring which is in communication with coolant/lube apertures and which serves to evenly provide lube/coolant to a can body to ease passage through a die element and prevent tear off and remelt. The downstream side of the die module receives the die assembly and includes a plurality of formed cavities having angular openings for receiving spring means to bias or float a die element to thereby permit proper alignment of the can body with the die element. Air channels are provided on the upstream surface of the die housing and are in communication with air inlet apertures contained in the tool pack assembly. Because a die assembly has a tendency to stick to the die module housing when a metal body is punched through the tool pack and body maker, the air flow in the channels forces the die assembly from the module surface and into a floating, recentered position.

Importantly, improved dampening means are provided for radial positioning of the die assembly in the die module housing. The dampening means comprises a spring means and a cooperating rigid contact body or pin member both having specified configurations. The spring means are preferably constructed of an elastomeric material, i.e., urethane or a like elastomeric compressible polymeric or other material having similar memory and dampening effects as urethane. The spring means may also be provided in a coil spring configuration or the like. The contact or pin members are preferably of a predetermined generally trapezoidal configuration which provide increased wear surfaces and are constructed of tool steel or a like hard and durable material. The spring means are constructed and arranged to cooperate with the pin or contact members to form the dampening means to bias or float the die element. Preferably the spring and contact members are interconnected to provide a joined structure.

It is an advantage of the present invention to provide a tool pack assembly capable of high cyclic operation, i.e. 500 cans per minute. It is a further advantage of the present invention to prevent damage to the can bodies during manufacture, i.e. tear-off and remelt, due to the use of the improved dampening means in the die module.

It is a benefit of the present invention to provide an improved die module which reliably and properly aligns a metal body driven by the body maker punch with an ironing die; i.e. by floating the die and by providing guiding means to center the metal body. It is a further benefit of the present invention to float the die using an elastomeric spring means which is durable and easily monitored and replaced. It is a further benefit of the present invention to provide a dampening means having a contact member which provides a relatively large wear surface.

These and other benefits and advantages of this invention will become clear from the following description by reference to the drawings.

DESCRIPTION OF THE PREFERRED EMBODIMENTS

Figure 1:
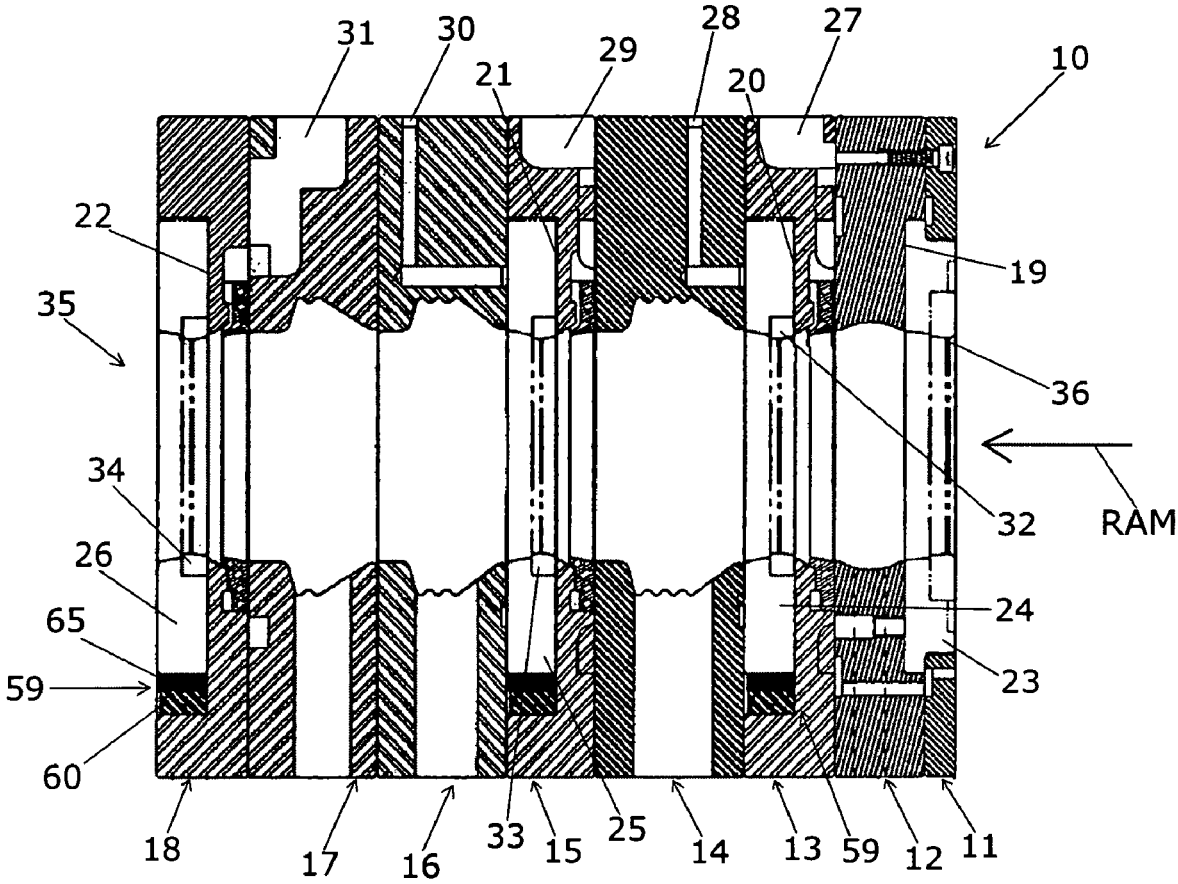
FIG. 1 is an axial sectional view of the tool pack assembly of the present invention.

The tool pack assembly of the present invention is constructed and arranged for use in the drawing and ironing of bodies for two piece metal cans. The tool pack assembly of the present invention is constructed and arranged for use in a body maker assembly for the manufacture of two piece can bodies. The tool pack assembly of the present invention is constructed to contain die elements to form the body parts of two piece metal cans and which further includes an improved single or double die module having improved dampening means. Although tool pack assemblies may comprise various configurations having various cooperating elements, an exemplary tool pack assembly 10 is discussed herein.

FIG. 1 shows tool pack assembly 10 being comprised of redraw die retainer 11, redraw die carrier 12, single die module 13, spacer member 14, single die module 15, spacer member 16, coolant spacer member 17 and single die module 18. Internal housing area 35 is shown defined by elements 11–18 and in which die assemblies are contained and through which a ram pushes or punches a formed metal member to form a metal container or a part thereof. Redraw die retainer 11 and carrier 12 and single die modules 13, 15 and 18 are constructed and arranged to hold a die assembly, namely a die ring member and a die element. For example, redraw die ring member 23 is shown adjacent die receiving shoulder 19 and held within redraw die retainer 11 and carrier 12. Similarly, die ring members 24, 25, and 26 are respectively shown adjacent die receiving shoulders 20, 21 and 22 of single die modules 13, 15, and 18, and thus located within the single die modules and in the internal housing area 35. The die assemblies are constructed and arranged so that a metal body may pass through redraw die element 36 and die elements 32–34. Dampening means 59 comprising elastomeric spring member 60 and cooperating contact or pin member 65 are shown held in the die modules, for example, as in die module 18.

Figure 2:
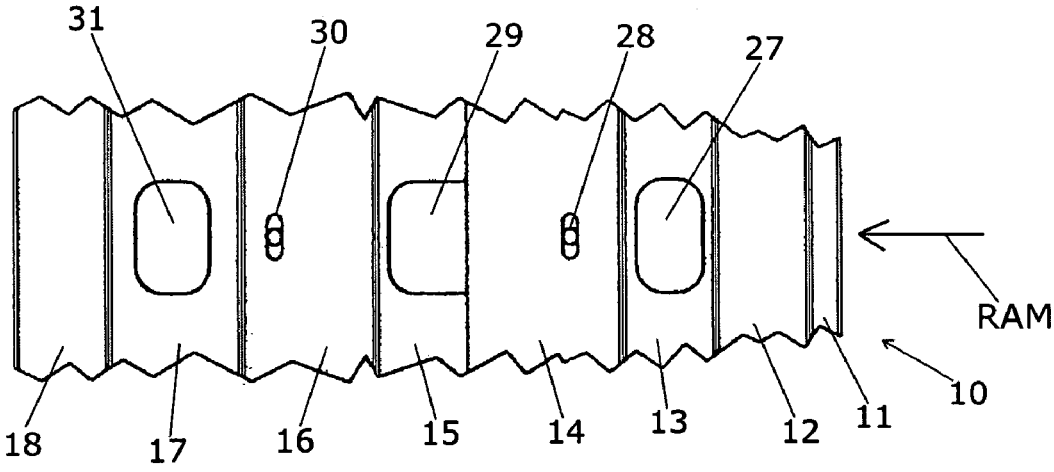
FIG. 2 is a partial top plan view of the tool pack assembly of the present invention.

Referring to FIGS. 1 and 2, fluid inlet apertures 27–31 are shown located in the top of elements 13–17. Fluid inlet apertures 27–31 are shown to be in communication with internal housing area 35. Fluid inlet apertures 27, 29 and 31 are constructed and arranged to be used for transporting lubricants or coolants into the housing and to the die ring members, while air inlet apertures 28 and 30 are constructed and arranged for transporting air into the housing. In order to improve metal body quality and to decrease product damage, i.e. to prevent tear-off and remelt, the metal body is preferably cooled before passing through each die. For example, in use, a metal body traveling through the tool pack assembly 10 is punched through single die module 15, die ring member 25 and die element 33. The metal body, having just passed through die element 32 of single die module 13, will have an increased temperature. Therefore, the metal body is preferably cooled before passing through die element 33. Coolant may be introduced to the metal body through aperture or port 29 and introduced into a lube ring pattern (discussed below with respect to FIG. 4) on single die module 13. Further, when punched, die assemblies may adhere or stick to the module housings, thus air inlet apertures 28 and 30 are provided in communication with housing 35 to provide air to an air channel pattern (discussed below with respect to FIG. 3) on the single die modules to loosen or float the die assembly with respect to the die modules.

The die modules, spacer members, and coolant and air apertures shown are exemplary and may have various configurations depending on application requirements. For example, as shown on die modules 13 and 15 of FIG. 1, coolant apertures 27 and 29 are contained within the modules along with the communication means for coolant to flow into housing 35 to cool the passing metal bodies. Alternatively, coolant aperture 31 is shown contained within coolant spacer 17 and in communication with single die module 18. Similarly, air inlet apertures 28 and 30 are shown contained in spacers 14 and 16, respectively, and in communication with die modules 13 and 15. Lubricants and airflow may be introduced to a tool pack assembly through various means. For example, lubricant and air outlet ports of the body maker structure may be aligned for communication with lubricant inlet ports and air inlet ports of the tool pack assembly. The lubricant inlet ports and air inlet ports may be constructed and arranged for communication with a lubricant ring contained, for example, within a die module and/or a spacer member to achieve the lubricating and airflow requirements for the tool pack assembly. Further, a double die module may be provided, as discussed below, for use within the tool pack assembly of the present invention.

Figure 3:
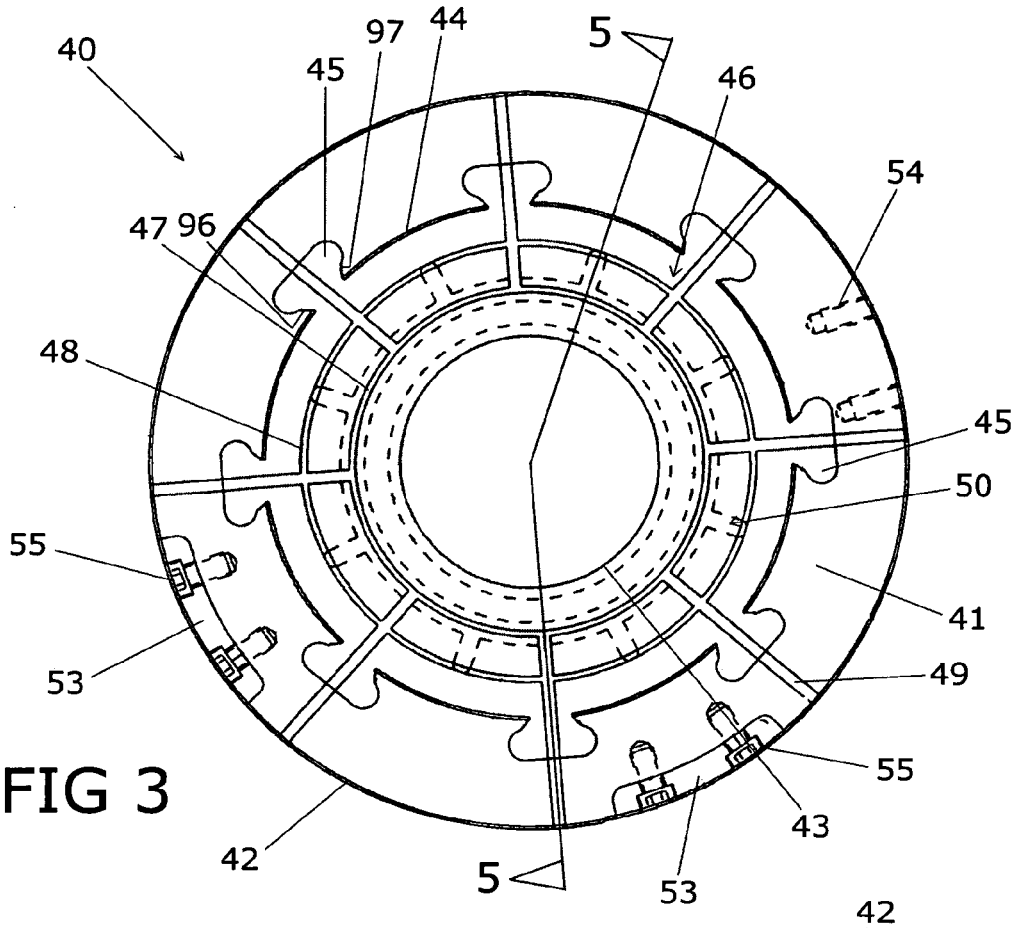
FIG. 3 is a radial sectional view of the of the tool pack assembly of FIG. 1, and showing a top or downstream plan view of the die module assembly of the present invention.

FIG. 3 shows a single die module 40 which includes housing 41 having a wall 44 having formed cavities 45 radially positioned therein. Single die module 40 is exemplary of a die module for use in the tool pack assembly of the present invention, for example single die modules 13, 15, and 18 of tool pack assembly 10. Housing 41 with wall 44 are constructed and arranged to receive a die assembly, for example a die ring member having a die element. The die module housing 41 has an outer perimeter wall 42 and an inner perimeter wall 43. As discussed above, air flow channel 46 is provided on the surface of single die module 40, air flow channel 46 having a pattern which is shown including eight radially extending grooves 49, an inner circular groove 47 and outer circular groove 48, all being in communication with each other to form air flow channel 46. Formed cavities 45, having angled walls 96 and 97 further discussed below, are constructed and arranged to receive dampening means, i.e. spring and contact members (discussed below with respect to FIGS. 8–10) which float a die assembly so that a metal body, driven by the body maker punch, passing through the tool pack is properly realigned with the die element to thereby prevent tear-off and to improve manufacturing efficiency and product quality. Cavities 45 are shown generally equally spaced around wall 44, however, it is within the purview of this invention to provide cavities 45 otherwise spaced around wall 44 to accommodate the weight of the die assembly, for example.

Figure 6:
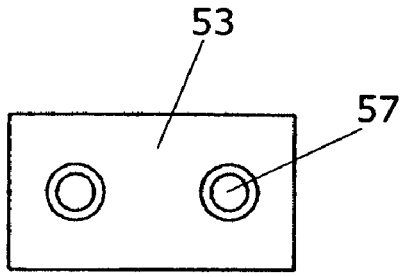
FIG. 6 is a front plan view of the wear plate member of the present invention.
Figure 7:
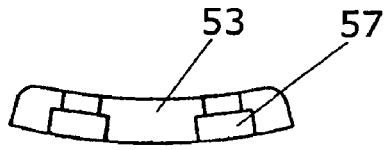
FIG. 7 is a top plan view of the wear plate member of FIG. 6.

As shown in FIG. 3, apertures 54 are located along the outer perimeter wall 42 of single die module 40 to receive a handle member (not shown). Wear plates 53 are shown positioned along perimeter wall 42 and held in place using fasteners 55, i.e., via screws. Further shown in FIGS. 6 and 7, each wear plate 53 has apertures 57 through which fasteners 55 may extend through and into cooperating apertures (not shown) located in single die module 40. Wear plates 53 are shown provided on the exterior of the single die module 40 of the tool pack assembly of the present invention at two positions of greatest contact that each single die module has with the rods of a clamped holding unit, for example. Therefore, wear plates are constructed and arranged to withstand high stress and, upon wear, the wear plates can be readily and easily replaced in a manner more cost effectively and efficiently than replacing or regrinding the entire single die module body as presently required in the art. The wear plates of the present invention are preferably constructed of a hard steel or like material.

Figure 4:
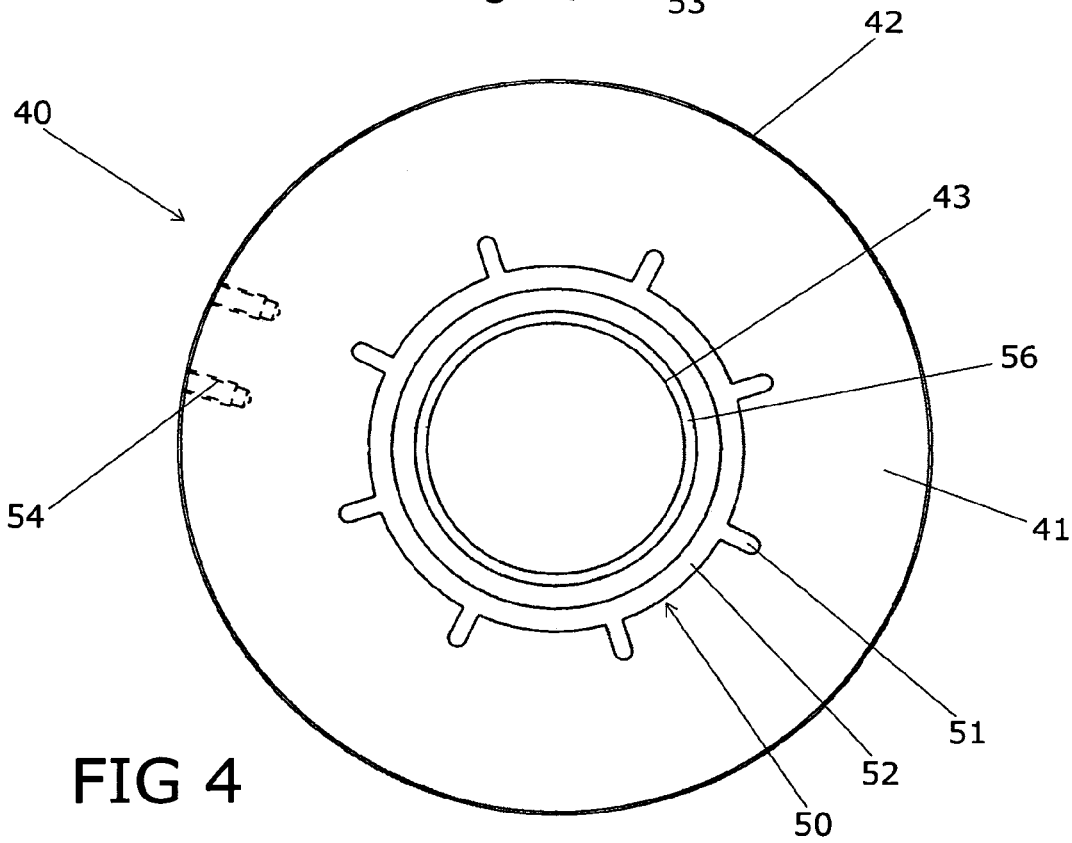
FIG. 4 is a bottom or upstream plan view of the die module assembly of FIG. 3.
Figure 5:
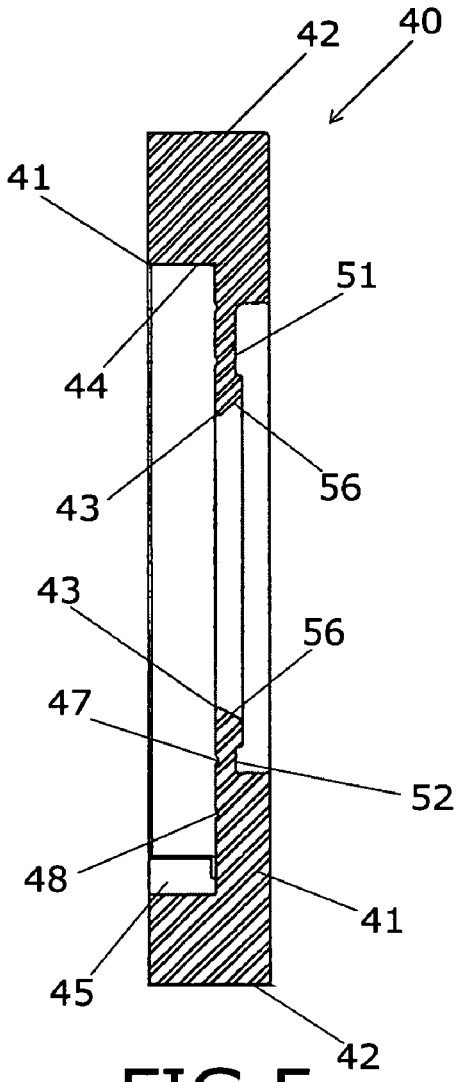
FIG. 5 is a side sectional view of the die module assembly taken along line 5—5 of FIG. 3.

Referring to FIGS. 4 and 5, outer perimeter wall 42 and inner perimeter wall 43 are shown defining the outer and inner boundaries of single die module 40. Tapered inner diameter wall 56 is shown and is constructed and arranged for communication with lubricant passageway 50 to distribute lubricant from an inlet means to a lube ring (not shown) located at inner diameter wall 56. Referring to FIG. 4, lubricant passageway 50 is shown having circular portion 52 and eight radially extending portions 51. As discussed with respect to FIGS. 1 and 2, coolant or a lubricant may be introduced into the tool pack assembly (via fluid inlet apertures) and may be in communication (via lubricant passageway 50 and tapered inner diameter wall 56) with a lube ring in order to cool and lubricate a passing metal body.

FIG. 5 is a cross-sectional view of single die module 40 taken along line 5—5 of FIG. 3. As shown, housing 41 having wall 44, inner perimeter 43 and tapered inner diameter wall 56 may form part of an internal housing area of a tool pack assembly when such a single die module is utilized with other elements to form a tool pack assembly. As discussed with respect to FIG. 3, inner circle 47 and outer circle 48 of air channel 46 and a formed cavity 45 are shown in the cross-section of FIG. 5. As discussed with respect to FIG. 4 above, circular portion 52 and one radially extending portion 51 of lubricant passageway 50 are shown in the cross sectional view of FIG. 5.

Figure 8:
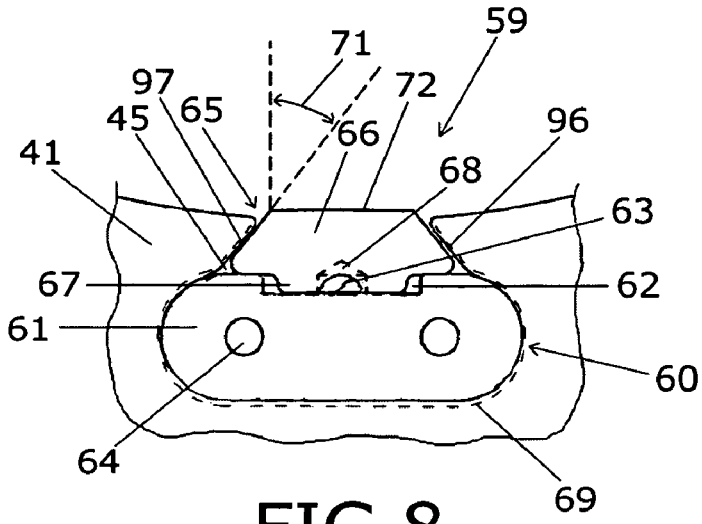
FIG. 8 is a top plan view of the formed cavity of FIG. 3 having an elastomeric dampening structure therein.
Figure 9:
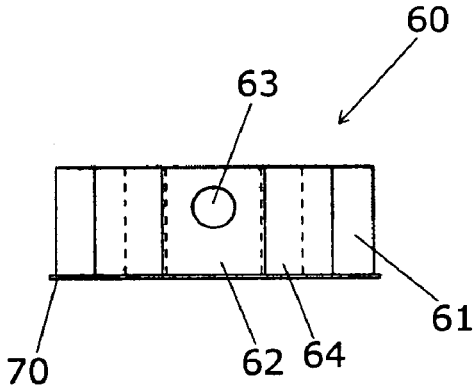
FIG. 9 is a side plan view of the elastomeric spring member of FIG. 8.
Figure 9A:
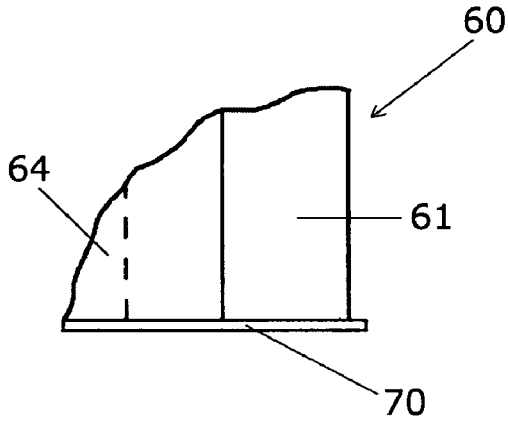
FIG. 9A is an enlarged partial view of FIG. 9 showing the bottom lip of the elastomeric spring member.
Figure 10:
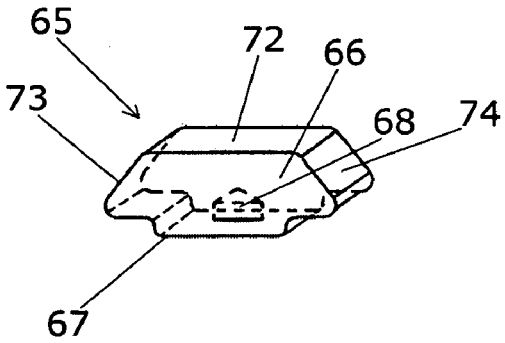
FIG. 10 is a perspective view of the contact member of the dampening means shown in FIG. 8.

FIG. 8 is an enlarged view of a formed cavity 45 of housing 41 of single die module 40. The formed cavity 45 is constructed and arranged to receive dampening means 59 comprising spring member 60 and contact member 65. The formed cavity 45 is shown having angled walls 96 and 97 which form and define an angled opening into the formed cavity and through which wear surface 72 of contact or pin member 65 extends. The formed cavity 45 is further shown constructed and arranged having an undercut peripheral edge 69. Referring to FIGS. 8 and 9, spring member 60 is shown comprised of body 61 having a generally elongated oval cross-sectional configuration. FIGS. 8 and 9 show body 61 having an indented portion 62 with protrusion 63 of body member 61 generally centrally disposed within indented portion 62. Apertures 64 are shown extending through body 61 to increase the functionality and life of the elastomeric spring body. Body member 61 of elastomeric spring member 60 is shown in FIGS. 9 and **9*a* to have a peripheral bottom lip 70 which is constructed and arranged for positioning in undercut peripheral edge 69 of the formed cavity 45. The latter arrangement aids in securing the spring member within cavity 45 and thus the dampening means. Referring to FIGS. 8 and 10, pin or contact member 65 is shown having a rigid truncated body comprised of body 66 having a generally trapezoidal cross-sectional configuration. Body 66 is shown having a protruding rear portion 67 which is constructed and arranged to cooperate with indented portion 62 of biasing member 60. Protruding rear portion 67 is further shown containing aperture 68 which is shown generally centrally disposed within portion 67 and which is constructed and arranged to cooperate with protrusion 63 of biasing or spring member 60**.

Importantly, contact member 65 preferably has a rigid angled body member 66 having adjoining wear surfaces 72, 73 and 74. Wear surfaces 73 and 74 are shown disposed at an angle 71 and which is approximately 40 degrees with respect to a radial line of the die module. The angle 71 may be within a range of approximately 25–55 degrees. As shown in FIG. 8, pin member 65 preferably extends from formed cavity 45 in order to make contact with and to float a die assembly, at wear surface 72. Wear surfaces 73 and 74 are constructed and arranged having generally the same angle as angled walls 96 and 97 of formed cavity 45, to thereby provide the greatest amount of wear surface for the pin member to engage a die ring.

Figure 11:
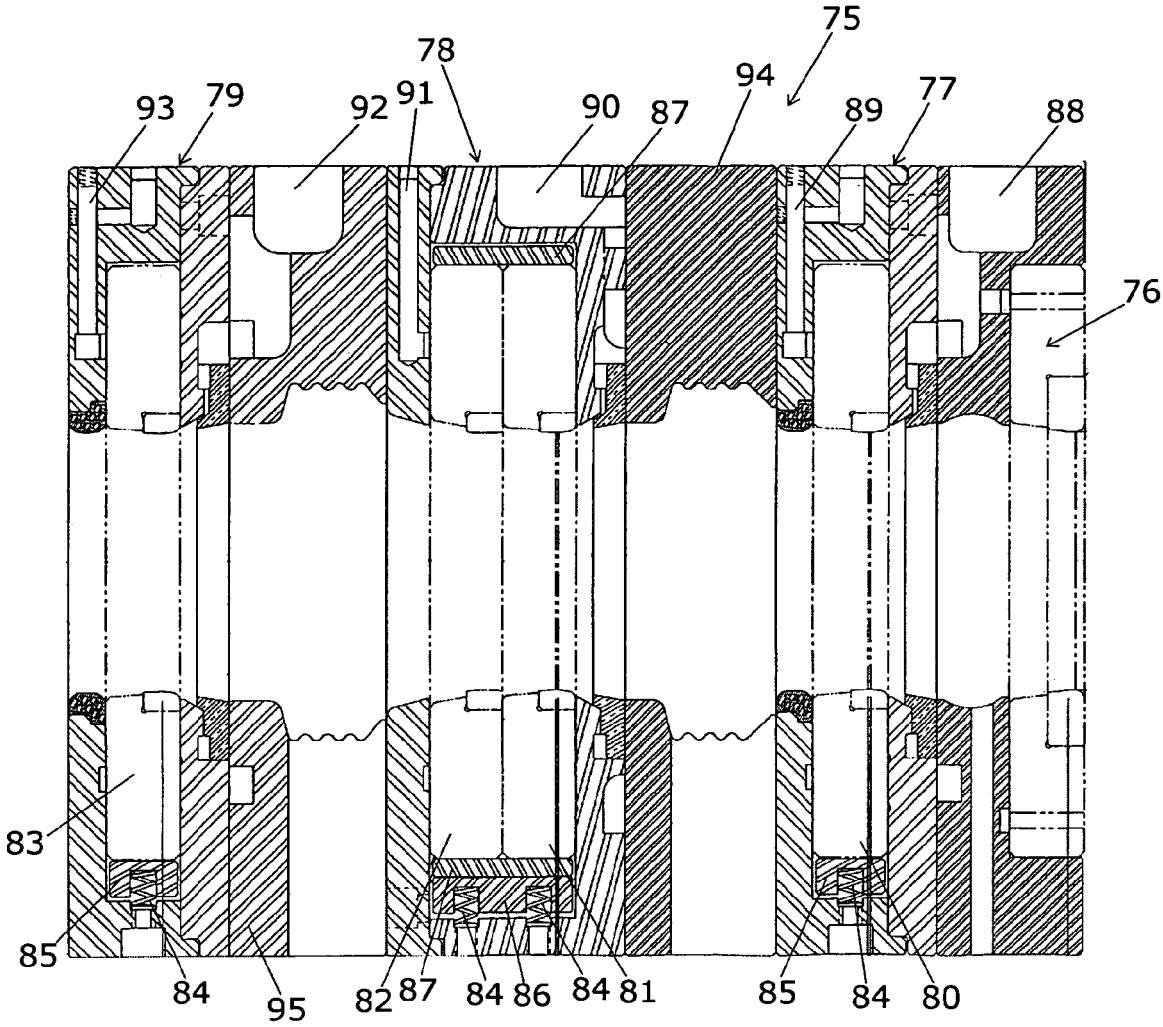
FIG 11 PRIOR ART
FIG. 11 is an axial sectional view of an exemplary prior art tool pack assembly.

The wear surfaces of the dampening structure are greatly enhanced and increased by this invention in comparison to the generally rounded pin structures of the prior art, as particularly shown in FIG. 11. In contrast with the round pin members of the '815 Patent, for example, the improved pin or contact member configuration of the present invention has a generally trapezoidal or a truncated shaped body having three wear surfaces and thereby provides enlarged contact and wear surface areas. The improved spring member body may have bores or apertures therethrough or therein (shown in FIGS. 8 and 9 as apertures 64) which provide increased compressibility and longevity parameters. The spring members are preferably constructed of urethane or a like compressible elastomeric material having similar dampening effects as urethane compounds and desired predetermined elasticity and hardness parameters, i.e. durometer readings. The cooperating pin or rigid truncated body members are preferably constructed of tool steel or a like hard and durable material. Further, it is within the purview of the invention to provide a spring member having a coil spring configuration for use with the pin or contact member 65, although the elastomeric spring members are preferred.

It is within the purview of this invention to provide a multiple or double die module for use in a tool pack assembly. A double die module may be provided having a carrier ring or housing constructed and arranged to hold two adjacent die assemblies. A double die module housing may also use the dampening means of the invention to float the joined two die assembly, i.e. a plurality of formed cavities holding spring and pin members. The formed cavities of a double die module would be deeper than the cavities of a single die module. The pin members used with a double die module would therefore provide a greater surface area to float the two adjacently mounted dies, and the spring members would be accordingly sized to cooperate with the increased pin member dimensions.

Further, a tool pack assembly of the present invention may be comprised of various combinations of drawing and/or ironing elements, depending on application requirements. For example, prior art tool pack 75 is shown in FIG. 11 having an alternate configuration. The tool pack assembly 75 is shown comprising redraw die assembly 76, single die module 77, double die module 78 and single die module 79 and spacer members 94 and 95. Single die modules 77 and 79 are shown housing die assemblies 80 and 83, respectively. Double die module 78 is shown housing die assemblies 81 and 82 within carrier ring 87. The use of a carrier ring is discussed above and is constructed to move the die assemblies in a double die module in sync or as a unit. Coil springs 84 are shown located within die modules 77, 78 and 79. Round-prior art pins 85 are shown used in a single die module, while round-prior art pin 86 is used with the double die module and is shown constructed and arranged to cooperate with both coil springs of the double die module. As discussed above, using the spring and pin combination shown in FIGS. 8–10, one elongated pin and cooperating spring member may also be used with a double die module. Lubricant inlets 88, 90 and 92 and air inlets 89, 91 and 93 are shown in communication with the die modules and die assemblies.

The configurations of the tool packs discussed herein are exemplary and the utilization of the inventive elements disclosed herein in any combination of redraw die modules, spacers, single die modules and/or double die modules is within the purview of this invention. Further, lube rings (not shown), lubricant inlet ports and air inlet ports may be located at various positions within any given tool pack assembly, for example, contained in a spacer member or in a die module.

As many changes are possible to the assemblies of this invention utilizing the teachings thereof, the descriptions above, and the accompanying drawings should be interpreted in the illustrative and not in the limited sense.

That which is claimed is:

1. A die module for a tool pack assembly for use in the high cyclic manufacture of container bodies comprising:

a) an annular die module body having an inner perimeter wall and an outer perimeter wall, said die module body having means to secure a die element;

b) a plurality of formed cavities extending into and radially spaced along said inner perimeter wall, each cavity having an inner and an outer portion;

c) an elastomeric dampening member positioned in said outer portion of each said formed cavity;

d) a rigid contact member positioned in said inner portion of each said formed cavity, said rigid contact member having a generally trapezoidal configuration with a plurality of wear surfaces and being constructed and arranged to contact said elastomeric member and to extend outward from said inner perimeter wall.

2. The die module of claim 1, wherein the inner portion of each said cavity has angled walls and wherein two of said plurality of wear surfaces of said trapezoidal contact member have generally the same angle and wherein said angle is between approximately 25 and 55 degrees.

3. The die module of claim 1, wherein said elastomeric dampening member is formed of polyurethane and wherein said rigid contact member is formed of tool steel.

4. The die module of claim 1, wherein said elastomeric dampening member and said rigid contact member have interconnection means.

5. The die module of claim 4, wherein said elastomeric dampening member is generally an oval structure having an indented portion with a generally centrally positioned protrusion and wherein said rigid contact member has a rear protruding portion having an aperture therein for receiving said protrusion of said elastomeric dampening member.

6. The die module of claim 1, wherein said plurality of formed cavities each have a generally V-shaped entry into said inner perimeter wall and wherein each said formed cavity is generally equally spaced about said inner peripheral wall of said die module body.

7. The die module of claim 1, wherein at least one wear plate member is mounted to said outer perimeter wall of said die module body.

8. The die module of claim 1, wherein said elastomeric dampening member has at least one bore therethrough.

9. The die module of claim 1, wherein each said formed cavity has a securement portion and wherein said elastomeric dampening member has a securement member for engaging said securement portion of said cavity.

10. The die module of claim 1, wherein said die module body has channels therethrough for lubricant flow and has second channels therethrough for air flow and wherein a plurality of die modules are utilized to form a tool pack assembly.

11. A tool pack assembly for holding die elements used with a cycling ram for the drawing and ironing of a metal body comprising:

a) a redraw die element retaining and carrier means;

b) at least one die module having an annular body and a plurality of dampening means for self centering a die element with respect to said cycling ram, wherein each said dampening means includes a rigid contact member having a plurality of wear surfaces; and c) at least one spacer member.

12. The tool pack assembly of claim 11, wherein said dampening means further includes an elastomeric spring member constructed and arranged for cooperation with said rigid contact member.

13. The tool pack assembly of claim 12, wherein said elastomeric member is comprised of urethane and is generally an oval structure and wherein said cooperating rigid contact member is generally a trapezoidal structure.

14. The tool pack assembly of claim 11, wherein said tool pack assembly further includes means to provide airflow to said die module and means to provide a lubricant fluid to said die module.

15. The tool pack assembly of claim 11, wherein said die module includes a plurality of radially disposed cavities, each cavity having a generally v-shaped entry constructed and arranged for receiving said dampening means.

16. The tool pack assembly of claim 14, wherein said means to provide air flow to said die module is provided in said spacer member and wherein said means to provide fluid to said die module is also provided in said spacer member.

17. The tool pack assembly of claim 14, wherein said means to provide air flow to said die module is contained in said at least one die module and wherein said means to provide lubricant fluid to said die module is contained in said at least one die module.

18. The tool pack assembly of claim 14, wherein said at least one die module has channels disposed therein for communication with said means to provide fluid and said means to provide air.

19. The tool pack assembly of claim 11, wherein said dampening means include a spring member having a coil spring configuration which is constructed and arranged for cooperation with said rigid contact member.

20. A die module for a tool pack assembly for use in the high cyclic manufacture of container bodies comprising:

a) an annular die module body having an inner perimeter wall and an outer perimeter wall, said die module body having means to secure a die element, said outer perimeter wall having at least one wear plate mounted therein;

b) a plurality of formed cavities extending into and radially spaced along said inner perimeter wall, each cavity having an inner and an outer portion and further having a securement portion;

c) an elastomeric dampening member positioned in said outer portion of each said formed cavity, said elastomeric dampening member having a securement member for engaging said securement portion of each said cavity; and d) a rigid body member positioned in said inner portion of each said formed cavity, said rigid body member having a plurality of wear surfaces and being constructed and arranged to contact said elastomeric dampening member and to extend outward from said inner perimeter wall.

* * * * *